US006320090B1

(12) United States Patent
Sherman et al.

(10) Patent No.: US 6,320,090 B1
(45) Date of Patent: Nov. 20, 2001

(54) METHOD OF REMOVING CONTAMINANTS FROM PETROLEUM DISTILLATES

(75) Inventors: Jeffrey H. Sherman, Dallas, TX (US); James W. Hershberger; Richard T. Taylor, both of Oxford, OH (US)

(73) Assignee: Miami University, Oxford, OH (US)

( * ) Notice: Subject to any disclaimer, the term of this patent is extended or adjusted under 35 U.S.C. 154(b) by 0 days.

(21) Appl. No.: 09/265,903

(22) Filed: Mar. 10, 1999

(51) Int. Cl.[7] ..... C07C 7/10; C07C 7/00; C10G 175/00; C10G 29/20

(52) U.S. Cl. ..... 585/833; 585/860; 208/180; 208/182; 208/184; 208/207; 208/236; 208/240; 208/289; 208/291

(58) Field of Search ..... 208/180, 182, 208/184, 207, 236, 240, 289, 291, 299, 307; 585/860, 820, 823, 826, 827, 831, 833

(56) References Cited

U.S. PATENT DOCUMENTS

| | | | | |
|---|---|---|---|---|
| 5,045,206 | * | 9/1991 | Chen et al. | 210/640 |
| 5,242,579 | * | 9/1993 | Mead et al. | 208/312 |
| 5,753,102 | * | 5/1998 | Funakoshi et al. | 208/208 R |
| 5,814,207 | | 9/1998 | Kenton | 208/184 |
| 5,880,325 | * | 3/1999 | Alward et al. | 585/833 |

* cited by examiner

*Primary Examiner*—Walter D. Griffin
*Assistant Examiner*—Tam M. Nguyen
(74) *Attorney, Agent, or Firm*—N. Alexander Nolte; Moser, Patterson & Sheridan L.L.P.

(57) ABSTRACT

Polynuclear aromatic hydrocarbons (PAHs) and other contaminants are removed from petroleum distillates by mixing a solvent with petroleum distillate to extract the contaminants therefrom. The solvent is recovered and distilled to separate the contaminants therefrom, and is then reused. The petroleum distillate having the contaminants separated therefrom is also distilled to remove any remaining solvent therefrom, with the recovered solvent being reused.

3 Claims, 2 Drawing Sheets

METHOD OF REMOVING CONTAMINANTS FROM PETROLEUM DISTILLATES

TECHNICAL FIELD

This invention relates generally to the removal of contaminants from petroleum distillates, and more particularly to a method of removing polynuclear aromatic hydrocarbons and other contaminants from petroleum distillates, particularly used motor oil distillates.

BACKGROUND AND SUMMARY OF THE INVENTION

Each year, about 20 million tons (150 million barrels) of used lubricating oils, such as automotive lubricating oils, gear oils, turbine oils and hydraulic oils which through usage or handling have become unfit for their intended use, are generated world-wide. Used oil accumulates in thousands of service stations, repair shops and industrial plants, derived from millions of cars and other machines. Lubricating oil does not wear out during use, but does become contaminated with heavy metals, water, fuel, carbon particles and degraded additives. Eventually the lubricating oil is so contaminated that it can not satisfactorily perform its lubricating function and must therefore be replaced. Most of this used oil is dumped (legally or illegally) or burned as low-grade fuel, but such methods of disposal are highly detrimental to the environment and can cause serious pollution. Public opinion and governmental requirements are increasingly demanding the recycling, rather than the burning or dumping, of waste products. Used lubricating oil may contain 60 to 80% highly valuable base oil (generally comprising mineral oil fractions with a viscosity of not less than 20 cSt at 40 degrees Centigrade), worth significantly more than heavy fuel oil. It is therefore desirable to extract and reuse this base oil.

To date, however, recycling has not generally been undertaken by the refiners of crude oil. This is because, although used oil represents a sizable raw material source for re-refining, its volume is relatively small in relation to the world's crude oil requirements, which currently exceed 9 million tons (65 million barrels) a day. In addition, used oil is contaminated by impurities which can cause expensive disruption and downtime in conventional large crude oil refineries. Furthermore, since used oil does not generally originate from one source in large volumes, its collection and handling require resources which are incompatible with the normal raw material logistics of large oil companies.

It has been known since the early 1900s that used lubricating oil from engines and machinery can be recycled. Such recycling grew and developed with the popularization of the automobile. During the Second World War, re-refining became more widespread due to the difficulties in supplying virgin lubricating oil. Used oil re-refining still continued in the 1960s and 1970s, but then became uneconomical. This was because the conventional re-refining processes at that time involved the addition of sulphuric acid in order to separate the contaminants from the useful hydrocarbon components of the used oil, thereby generating as a waste product a highly toxic acid sludge. With the increased use of performance-enhancing oil additives towards the end of the 1970s, the amount of acid sludge generated by conventional re-refining plants grew to an unacceptable level. In the United States of America, it has been reported by the American Petroleum Institute that, as a consequence of legislation prohibiting the land filling of acid sludge generated by conventional re-refining operations, the number of used oil re-refining plants has dropped from 160 in the 1960s to only three today.

As an alternative to the acid treatment process for the re-refining of used oil, various evaporation/condensation processes have been proposed. In an attempt to obtain high operating efficiency, it is generally suggested that thin film evaporators be used. These evaporators include a rotating mechanism inside the evaporator vessel which creates a high turbulence and thereby reduces the residence time of feedstock oil in the evaporator. This is done in order to reduce coking, which is caused by cracking of the hydrocarbons due to impurities in the used oil. Cracking starts to occur when the temperature of the feedstock oil rises above 300 degrees Centigrade, worsening significantly above 360 to 370 degrees Centigrade. However, any coking which does occur will foul the rotating mechanism and other labyrinthine mechanisms such as the tube-type heat exchangers which are often found in thin film evaporators. These must therefore be cleaned regularly, which leads to considerable downtime owing to the intricate structure of the mechanisms.

It is known from WIPO Document Number WO-91/17804 dated November, 1991, to provide an evaporator which may be used in the re-refining of used oil by distillation. This evaporator comprises a cyclonic vacuum evaporator in which superheated liquid is injected tangentially into a partially evacuated and generally cylindrical vessel. The inside of the vessel is provided with a number of concentric cones stacked on top of one another which serve to provide a reflux action. As a result of coking, however, the evaporator still needs to be shut down periodically in order to undertake the intricate and time-consuming task of cleaning the cones.

U.S. Pat. No. 5,814,207 discloses an oil re-refining method and apparatus wherein a re-refining plant comprises two or more evaporators connected to one another in series. Feedstock used oil is first filtered to remove particles and contaminants above a predetermined size, for example 100 to 300 $\mu$m, and is then passed to the first evaporator by way of a buffer vessel and a preheating tank, where the feedstock is heated to approximately 80 degrees Centigrade. Additional chemical additives, such as caustic soda and/or potash, may be introduced at this stage. The feedstock is then injected substantially tangentially into the first evaporator, in which the temperature and pressure conditions are preferably from 160 to 180 degrees Centigrade and 400 mbar vacuum to atmospheric pressure respectively. Under these conditions, water and light hydrocarbons (known as light ends, with properties similar to those of naphtha) are flashed off and condensed in the spray condenser of the evaporator and/or in an external after-condenser. These fractions generally account for between 5 to 15% of the used oil volume. The cyclonic vacuum evaporation process combined with the use of a spray condenser produces a distilled water which has a relatively low metal and other contaminant content. Light ends present in the water are then separated, and may be used as heating fuel for the re-refining process. The water may be treated in order to comply with environmental regulations and may be discharged or used as a coolant or heating fluid in the re-refining process. The bottoms product, comprising the non-distilled 85 to 95% of the used feedstock oil, is recirculated as described above. In the recirculation circuit, the bottoms product is heated, preferably to 180 to 200 degrees Centigrade, and mixed with the primary feedstock supply for reinjection into the first evaporator. Advantageously, the pump in the recirculation circuit generates a recirculation flow rate greater than the initial feedstock flow rate. This helps to reduce coking in the recirculation pipes since overheating of the oil in the heat exchanger is avoided. The recirculation flow rate should be large enough to generate a well turbulent flow, and accordingly depends on the heat exchanger duty and on the size of the pipe lines. This is typically achieved with a recirculation flow rate 5 to 10 times greater than the initial feedstock flow rate.

A proportion of the recirculating bottoms product from the first evaporator is fed to and injected into a second evaporator. This second evaporator is substantially similar to the first evaporator, but the temperature and pressure conditions are preferably from 260 to 290 degrees Centigrade and 40 to 100 mbar vacuum respectively. Under these conditions, a light fuel oil (similar to atmospheric gas oil) and a spindle oil (having a viscosity at 40 degrees Centigrade of about 15 cSt) are flashed off as overhead products, leaving behind a bottoms product from which the base oil distillate is to be recovered. These gas oil and spindle oil fractions generally account for between 6 to 20% of the original used oil volume. The condensed fractions are fed to storage and may be subjected to a finishing treatment, the severity of which will be determined by final usage and market requirements. The bottoms product of the second evaporator is recirculated as in the first evaporator, but at a temperature preferably in the region of 280 degrees Centigrade, and a proportion of the recirculated product is fed to and injected into a third evaporator.

The third evaporator preferably operates at temperature and pressure conditions of around 290 to 330 degrees Centigrade and 15 to 25 mbar vacuum respectively. These operating values may be varied within predetermined limits (generally +/−10%) to suit the required distillate output products. Advantageously, the third evaporator is in communication with first and second spray condensers. The second spray condenser serves to condense some of the lighter fractions from the vapor phase which passes through the first spray condenser.

Two base oil fractions are produced in the third stage as overhead distillate products and fed to storage. The first and second spray condensers, operating at elevated temperatures (100 to 250 degrees Centigrade) allow a partial condensation whereby two specific distillate fractions can be produced. The spray condensers have the added advantage that the temperature as well as the recirculation flow rate can be varied, thereby allowing a flexible fractionation. The viscosity of the fractions may be altered by adjusting the ratio of temperature to recirculation flow rate; by increasing the condenser temperature, a heavier oil fraction can be produced. The base oil fractions extracted by the third evaporator generally account for about 10 to 50% of the used oil volume. The bottoms product is recirculated at around 330 degrees Centigrade as before, and a proportion of the recirculated product is fed to and injected into a fourth evaporator.

The fourth evaporator preferably operates at temperature and pressure conditions of around 320 to 345 degrees Centigrade and 5 to 15 mbar vacuum respectively. Further base oil fractions, which are heavier than those extracted in the third stage, are flashed off as overhead products and are condensed as base oil distillate fractions and fed to storage. In certain embodiments, the evaporator may be operated in a blocked manner, whereby a number of discrete temperature and pressure conditions are applied in order to extract specific fractions from the feedstock. Each such fraction is preferably fed to individual storage. The base oil fractions extracted by the fourth evaporator generally account for about 10 to 50% of the original used oil volume; this depends to some extent on the general viscosity of the used feedstock oil. The remaining bottoms concentrate contains heavy metals from the used oil, and sediments, carbon particles, ash and various non-volatile oil additives. This bottoms concentrate is fed to storage and is suitable for use as a roofing flux, a cold patch material or an asphalt extender. Where environmental regulations permit, the bottoms concentrate may be used as a heavy fuel oil in applications such as cement kilns, blast furnaces or incinerators. Dependent on its intended usage, the evaporator conditions may be set to produce a bottoms concentrate at viscosities ranging from 380 cSt at 40 degrees Centigrade for heavy fuel to 200 cSt at 135 degrees Centigrade for asphalt use.

The distillate fractions typically amount to 85–95% of the used lubricating oil, leaving 5–15% as bottoms. The base oil distillate fractions may be treated to produce finished base oils (which have viscosities of not less than 20 cSt at 40 degrees Centigrade and have characteristics similar to those of virgin base oils). Depending on the fractions contained in the used oil and on market requirements, the base oil fractions that are typically produced are 100 SN (solvent neutral), 150 SN, 250 SN and 350+SN. If only one or two wider base oil fractions are required, the fourth evaporator may be omitted.

As an alternative to the multi-stage distillation plant described above, it is possible to utilize a single evaporator operating in a blocked manner. The various fractions may then be extracted sequentially by applying predetermined temperature and pressure conditions in the evaporator. This has the advantage over a multi-stage plant of requiring less capital expenditure, but is less efficient since continuous process conditions can not be achieved.

The raw base oil distillates may contain volatile contaminants, oxidation compounds, unstable sulphur compounds and various decomposition products from additives, depending on the type and quality of the feedstock. It is therefore advantageous to provide a finishing treatment in which base and fuel oil distillates are chemically treated in order to remove unstable or other undesirable components.

Copending application Ser. No. 09/250,741, filed Feb. 16, 1999 assigned to the assignee hereof discloses a method of removing acidic compounds, color, and polynuclear aromatic hydrocarbons (PAHs), and removing or substituting heteroatoms from used oil distillates, such as those produced by the foregoing process. In the practice of the method, an organic or inorganic base, a transfer catalyst, and the used oil distillate are mixed and heated. Thereafter, the contaminants are removed by distillation. The method may be operated either in a batch mode or in a continuous mode. When the continuous mode is used, the method may be used prior to, or concurrent with, the method of U.S. Pat. No. 5,814,207 as described above. By means of the method, the complexity of the apparatus of the '207 Patent is substantially reduced.

PAHs are a frequently found class of contaminants in used motor oils, especially, used oils generated from Diesel engines. PAHs are found in virgin motor oils, albeit at low levels. PAHs are more concentrated in used oil as PAHs are produced in the combustion process that takes place in gasoline or diesel fueled engines.

As some PAHs are suspected carcinogens, it is desirable to remove the PAHs from used motor oil to enhance the value and quality of re-refined motor oils. In addition to PAHs, other contaminants exist in used oil that are difficult at best to remove through distillation or chemical treatment. These compounds include sulfur and nitrogen-containing organic compounds and compounds that absorb light which leads to a colored appearance of the re-refined oil.

Traditionally, PAHs have been removed from used motor oils through hydrotreating. Hydrotreating is a hydrogenation technology by which a used oil distillate is exposed to high pressure hydrogen and a catalyst at a high temperature. The resulting oil is typically lower in PAH content and other contaminants. While somewhat effective, hydrotreating is extremely expensive, so much so that it is frequently not economically feasible as a used oil re-refining process. Additionally, a major drawback to hydrotreating is the fact that the products resulting from the hydrotreating process remain in the used oil. These compounds may, at times, be more mutagenic or carcinogenic than the original PAH molecules.

The process of the above-referenced copending application is successful in removing PAHs from used motor oil to a certain extent. In many instances the results obtained by the method of the copending application are quite adequate. It has been found, however, that PAH's, sulfur-containing substances, nitrogen-containing substances, and other contaminant remain in the used motor oil after it has been processed in accordance with the method of the copending application. The present invention comprises a process which is employed after the method of the copending application to further reduce the presence of PAHs, sulphur and nitrogen-containing substances, and other contaminants from used motor oil distillates.

The present invention is especially applicable to the removal of contaminants from used oil distillates. The invention is also useful in removing PAHS, sulfur-contain substances, nitrogen-containing substances and other contaminants from virgin oil distillates and other petroleum distillates, it being understood that in most cases virgin oil distillates and similar petroleum distillates will not require pre-processing in accordance with the method of the copending application. Other applications of the invention will readily suggest themselves to those skilled in the art.

In accordance with the present invention, petroleum distillate is contacted with a highly polar organic solvent, such as N, N-dimethylformamide (DMF). It has been found that DMF is especially selective towards PAHs. Additionally, it has been found that in addition to PAHs, the solvent system is also selective towards various sulfur-containing molecules. Sulfur-containing molecules are undesirable in base oil and other petroleum products as they decrease the overall oxidation stability of the petroleum products.

While solvent extraction is a well known technique for manufacturing virgin base oil, its use in the manufacture of re-refined base oil is not well known, if at all. Further, the solvents used in the manufacture of virgin base oil are less polar than the solvents used in the present system. The lower polarity of the solvents commonly used in base oil manufacture leads to a significant loss of desirable base petroleum compounds.

Specifically, the present invention consists of a liquid/liquid extraction system in which the petroleum distillate is contacted with the organic solvent. As the organic solvent is imiscible with the petroleum distillate, the recovered solvent is easily separated from the petroleum distillate after the appropriate contact. Any residual solvent in the petroleum distillate is easily removed through evaporation, adsorption or other common separation methods. The spent solvent is easily separated from the extracted PAHs and other contaminants, and can be continuously regenerated and used.

BRIEF DESCRIPTION OF THE DRAWINGS

A more complete understanding of the invention may be had by reference to the following Detailed Description when taken in conjunction with the accompanying Drawings wherein.

DETAILED DESCRIPTION

Figure 1:
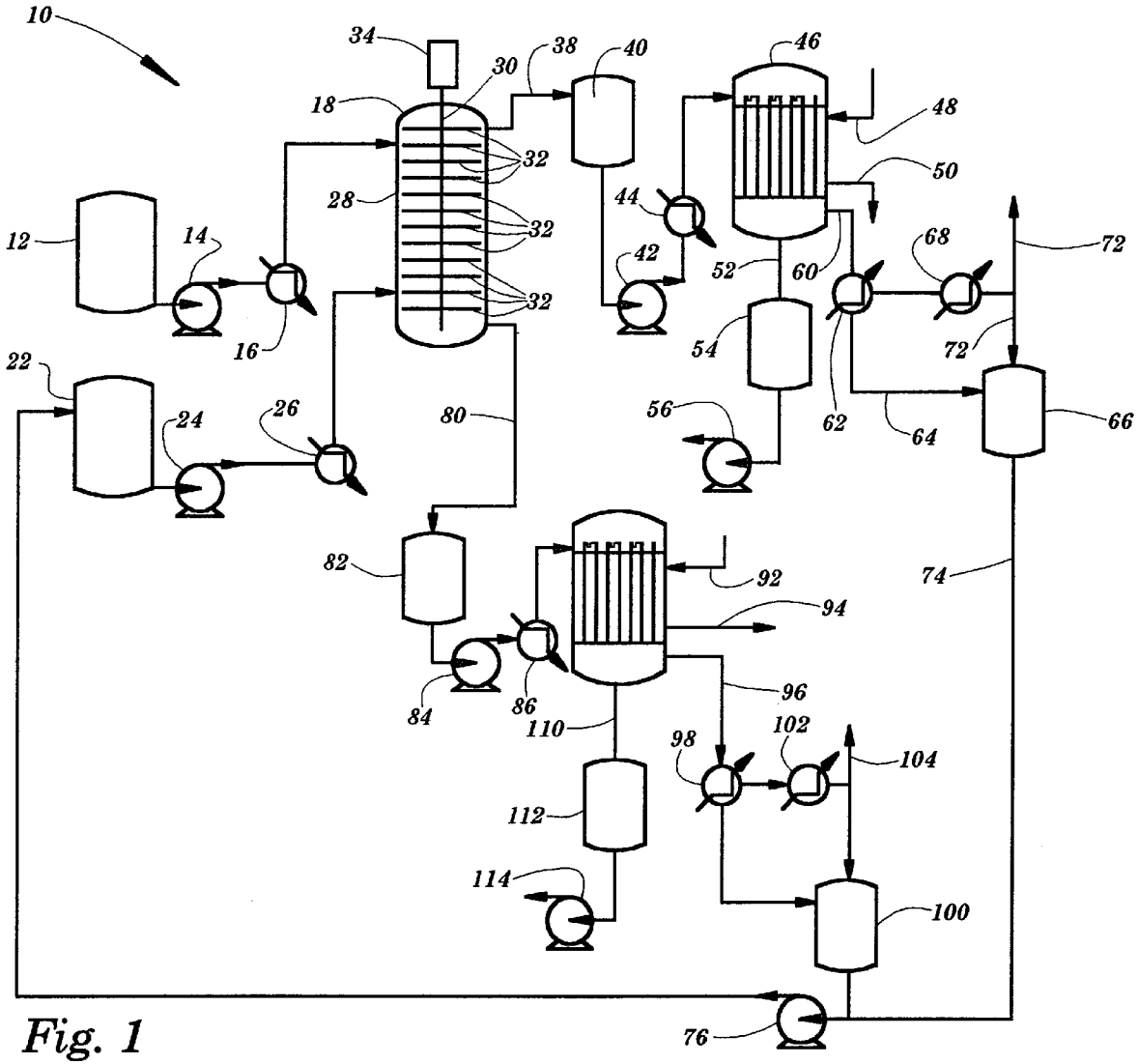
FIG. 1 is a schematic illustration of a method for removing polynuclear aromatic hydrocarbons and other contaminants from petroleum distillates comprising the first embodiment of the invention.

Referring now to the Drawings, and particularly to FIG. 1 thereof, there is illustrated a system 10 for removing polynuclear aromatic hydrocarbons (PAHs), sulphur and nitrogen-containing substances and other contaminants from petroleum distillates comprising the first embodiment of the invention. The method of FIG. 1 is particularly useful in those instances in which the solvent which is employed in the practice of the invention is lighter, i.e., less dense, than the petroleum distillate from which the contaminants are being extracted.

Petroleum distillate is directed from a source 12 through a pump 14 and through a heat exchanger 16 which increases temperature of the petroleum distillate to the top of a Karr column 18. Simultaneously a solvent is directed from a source 22 through a pump 24 and through a heat exchanger 26 which increases the temperature of the solvent to the bottom of the Karr column 18. The solvent which is utilized in the practice of the invention preferably comprises a highly polar organic solvent, such as N,N-dimethylformamide (DMF). Solvents such as acetonitrile may also be used in the practice of the invention. The polarity of the solvent may be adjusted by the addition of water and/or other materials depending upon the requirements of particular applications of the invention.

The Karr column 18 comprises a tank 28 having a rod 30 vertically disposed therein. A plurality of shelves 32 are secured to the rod 30 for vertical reciprocation thereby. The rod 30 extends to an actuator 34 which functions to reciprocate the rod 30 and the shelves 32 vertically at a predetermined rate.

Each of the shelves 32 has a plurality of holes formed therethrough. Because the solvent from the source 22 is relatively less dense, it tends to move upwardly in the tank 28 relative to the downwardly moving petroleum from the source 12. Conversely, because the petroleum distillate from the source 12 is relatively dense, it tends to move downwardly in the tank 28 relative to the solvent. The vertical reciprocation of the shelves 32 and the fact that the shelves 32 have holes therethrough substantially increases the surface area between upwardly moving solvent and the downwardly moving petroleum. By this means the solvent functions to extract PAHs and other contaminants which are present in the petroleum distillate therefrom, and to carry the extracted contaminants upwardly out of the tank 28.

The solvent having the contaminants from the petroleum distillate dissolved therein is recovered from the tank 28 through an outlet 38 and is directed to a surge tank 40. From the surge tank 40 the solvent/contaminant solution is directed through a pump 42 and through a heat exchanger 44 which increases the temperature of the solution to a falling film evaporator 46.

The falling film evaporator 46 is actuated by steam which received through an inlet 48 and recovered through an outlet 50. The falling film evaporator 46 functions to evaporate the solvent, thereby separating the solvent from the PAHs and other contaminants dissolved therein. The contaminants are recovered from the falling film evaporator 46 through an outlet 52. The contaminants flow through a surge tank 54 to a pump 56 for which directs the contaminants to suitable utilization apparatus. For example, the contaminants may be directed to an asphalt storage tank, etc.

The solvent is recovered from the falling film evaporator 46 through an outlet 60 and is directed to a heat exchanger 62 which removes heat from the solvent. Liquid solvent recovered from the heat exchanger 62 is directed through an outlet 64 to a surge tank 66. Solvent which is still in the vapor phase after passing through the heat exchanger 62 is directed to the heat exchanger 68. Liquid solvent from the heat exchanger 68 is directed to the surge tank 66 through an outlet 70, and solvent which remains in the vapor stage is directed to a vent 72. Solvent from the surge tank 66 is directed through an outlet 74 to a pump 76 which returns the solvent to the source 22.

Petroleum distillate having the contaminants removed therefrom is recovered from the tank 18 through an outlet 80 and is directed to a surge tank 82. From the surge tank 82 the petroleum distillate is directed through a pump 84 and through a heat exchanger 86 which adds heat to the petroleum distillate to a falling film evaporator 90. The falling film evaporator 90 is actuated by steam which is received through an inlet 92 and recovered through an outlet 94.

The falling film evaporator 90 functions to remove any remaining solvent from the petroleum distillate. The solvent is recovered from the falling film evaporator 90 through an outlet 96 and is directed to a heat exchanger 98 which removes heat from the solvent. Liquid solvent recovered from the heat exchanger 98 is directed to a surge tank 100. Any solvent which remains in the vapor phase after passing through the heat exchanger 98 is directed to a second heat exchanger 102. Liquid solvent recovered from the heat exchanger 102 is directed to the surge tank 100. Any solvent remaining in the vapor phase after passing through the heat exchanger 102 is directed to a vent 104. Liquid solvent from the surge tank 100 is directed to the pump 76 which returns the solvent to the source 22.

Petroleum distillate having substantially all polynuclear aromatic hydrocarbons, sulphur and nitrogen-containing substances and other contaminants removed therefrom is recovered from the falling film evaporator 90 through an outlet 110. The petroleum distillate passes through a surge tank 112 and from the surge tank 112 to a pump 114 which directs the petroleum distillate to storage facilities and/or further processing apparatus.

Figure 2:
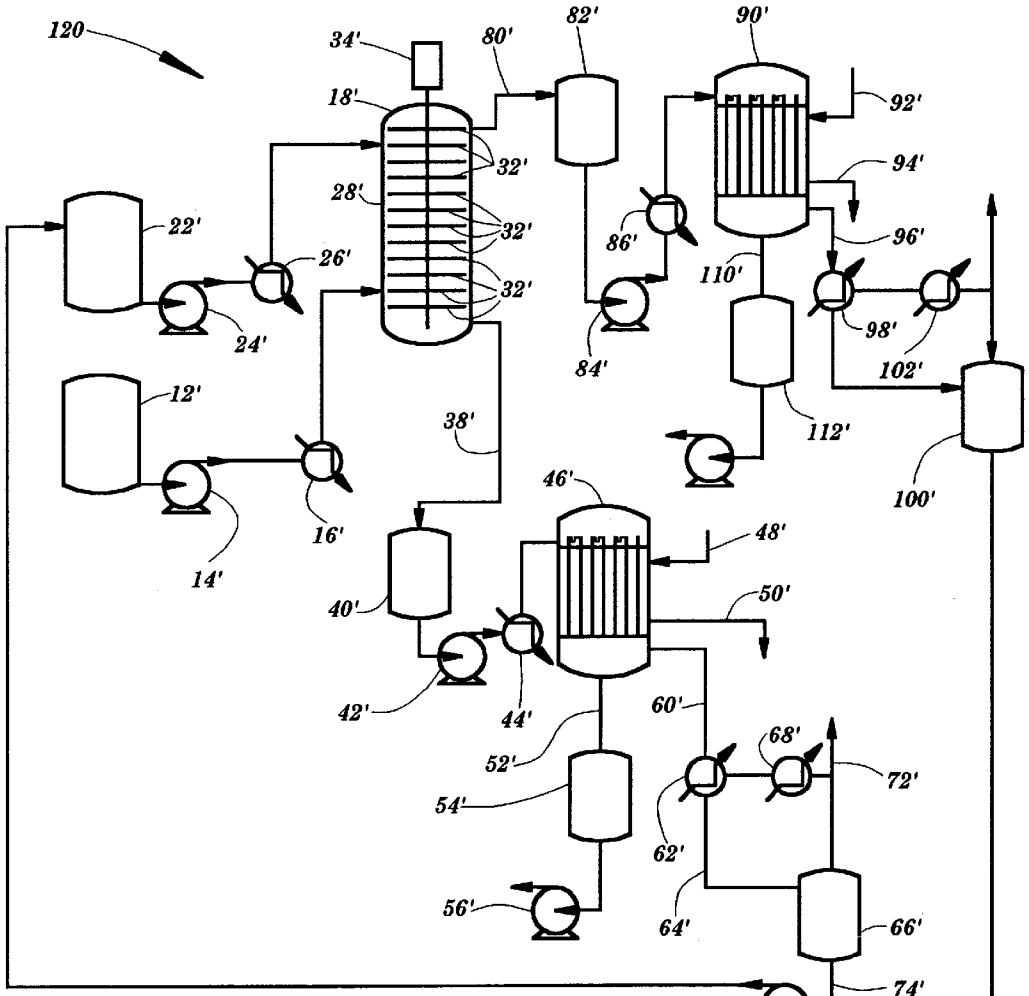
FIG. 2 is a schematic illustration of a method of removing polynuclear aromatic hydrocarbons and other contaminants from petroleum distillates comprising the second embodiment of the invention.

FIG. 2 illustrates a system 120 for removing polynuclear aromatic hydrocarbons and other contaminants from petroleum distillate comprising a second embodiment of the invention. The system 120 includes numerous component parts which are substantially identical in construction and function to the component parts of the system 10 illustrated in FIG. 1 and described hereandabove in connection therewith. Such identical component parts are designated in FIG. 2 with the same reference numerals utilized above in the description of the system 10, but are differentiated thereof by means of a prime (') designation.

The system 120 of FIG. 2 differs from the system 10 of FIG. 1 in that the system 120 is utilized in those instances in which the solvent is heavier, i.e., more dense, than the petroleum distillate. In such cases the solvent is directed to the top of the tank 281 and is recovered from the bottom thereof after extracting the polynuclear aromatic hydrocarbons from the petroleum distillate. Conversely, the petroleum distillate from the source 12' is directed to the bottom of the tank 281 and is recovered from the tank thereof following removal of the polynuclear aromatic hydrocarbons and other contaminants from the petroleum distillate by the action of the solvent. Otherwise, the operation of the system 120 of FIG. 2 is virtually identical to the operation of the system 10 of FIG. 1.

Figure 3:
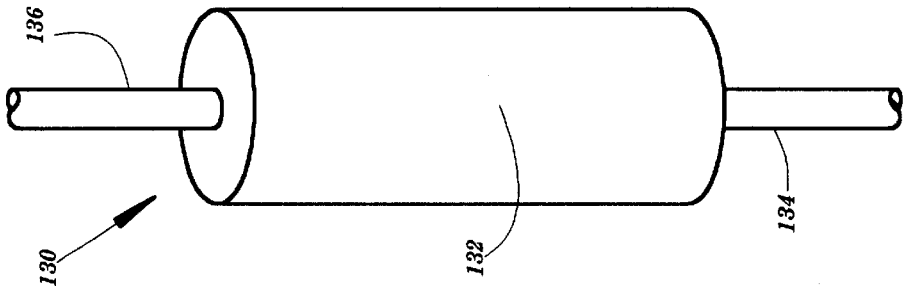
FIG. 3 is a schematic illustration of a method of removing polynuclear aromatic hydrocarbons and other contaminants from petroleum distillates comprising a third embodiment of the invention.

Referring now to FIG. 3, there is shown a system 130 for removing PAHs and other contaminants from petroleum distillates comprising a third embodiment of the invention. In accordance with the third embodiment of the invention, a tank or column 132 is filled with a filter material comprising activated charcoal or carbon. The tank 132 has an inlet 134 and an outlet 136.

In the practice of the third embodiment of the invention, petroleum distillate which, in the case of a used motor oil distillate, has previously been processed in accordance with the method of the above-identified copending application Ser. No. 09/250,741 filed now U.S. Pat. No. 6,007,701 is directed into the tank 132 through the inlet 134 and is removed from the tank through the outlet 136. The activated charcoal and/or carbon filter material within the tank 132 removes the PAHs as well as other contaminants from the petroleum distillate, such that when the petroleum distillate is recovered through the outlet 136, it is substantially free of contaminants.

The activated charcoal and/or carbon filter material used in the practice of the third embodiment of the invention is periodically refreshed. This is accomplished by heating the charcoal and/or carbon with steam or heated nitrogen, while simultaneously applying a vacuum thereto.

As is well known, filter materials comprising activated charcoal and/or carbon are commonly used to remove odors, color, and other contaminants from liquids, etc. In such applications the activated charcoal and/or carbon gradually becomes filled with removed contaminants, whereupon the activated charcoal and/or carbon must be replaced.

It has been found in the practice of the present invention that replacement of the activated charcoal and/or carbon filter material within the tank 132 is not necessary. The removal of PAHs and other contaminants from petroleum distillate by the activated charcoal/carbon filter material and the periodic refreshment of the contents of the tank 132 results in an increase of the quantity of charcoal/carbon within the tank. Thus, in the practice of the invention activated charcoal and/or carbon filter material is periodically removed from the tank 132 and may be used for other purposes, or sold.

The present invention is highly successful in improving the quality of used oil distillates. Thus, in the practice of the invention, the concentration of PAHs in used oil distillates is reduced from about 200 ppm to about 1 ppm or to even lower concentrations depending upon the requirements of particular applications of the invention. The use of the method of the invention is also successful in reducing the color of used oil distillates to a level comparable with that of used oil distillates that have been hydrotreated.

Although preferred embodiments of the invention have been illustrated in the accompanying Drawings and described in the foregoing Detailed Description, it will be understood that the invention is not limited to the embodiments disclosed, but is capable of numerous rearrangements, modifications, and substitutions of parts and elements without departing from the spirit of the invention.

We claim:

1. A process for removing polynuclear aromatic hydrocarbons and sulfur-containing compounds from petroleum distillates comprising the steps of:

providing a petroleum distillate containing polynuclear aromatic hydrocarbons and sulfur-containing compounds;

contacting said petroleum distillate with a single solvent which is immiscible in the petroleum distillate, which is highly selective toward polynuclear aromatic hydrocarbons, and which has a polarity;

separating said solvent from said petroleum distillate; and separating said polynuclear aromatic hydrocarbons and sulfur-containing compounds from said solvent.

2. The process for removing polynuclear aromatic hydrocarbons and sulfur-containing compounds from petroleum distillates as recited in claim 1 comprising the additional step of:

recovering any remaining solvent from said petroleum distillate.

3. The process for removing polynuclear aromatic hydrocarbons and sulfur-containing compounds from petroleum distillates as recited in claim 2 comprising the additional step of:

reusing said recovered solvent to extract polynuclear aromatic hydrocarbons and sulfur-containing compounds from subsequent quantities of petroleum distillate.

* * * * *

UNITED STATES PATENT AND TRADEMARK OFFICE

CERTIFICATE OF CORRECTION

PATENT NO. : 6,320,090 B1 
DATED : November 20, 2001
INVENTOR(S) : Jeffrey H. Sherman et al.

It is certified that error appears in the above-identified patent and that said Letters Patent is hereby corrected as shown below:

Column 5,
Line 32, please change "sulfur-contain" to -- sulfur-containing --.

Column 7,
Line 6, please add -- is -- after "which".
Line 13, please change "56 for which" to -- 56 which --.

Column 8,
Line 7, please change "281" to -- 28' --.
Line 11, please change "281" to -- 28' --.

Signed and Sealed this

Eleventh Day of March, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,320,090 B1 
DATED : November 20, 2001
INVENTOR(S) : Jeffrey H. Sherman et al.

It is certified that error appears in the above-identified patent and that said Letters Patent is hereby corrected as shown below:

Title page,
Item [75], Inventors, please insert -- Garrett M. Conn, Hinckley, OH (US) --

Signed and Sealed this

Nineteenth Day of August, 2003

JAMES E. ROGAN
*Director of the United States Patent and Trademark Office*